United States Patent [19]

Ottenhue

[11] 4,137,843

[45] Feb. 6, 1979

[54] ROTARY INTAGLIO PRINTING PRESS WITH AN INSERTABLE AND WITHDRAWABLE INKING MECHANISM

[75] Inventor: Ludger Ottenhue, Riesenbeck, Fed. Rep. of Germany

[73] Assignee: Windmoller & Holscher, Lengerich, Fed. Rep. of Germany

[21] Appl. No.: 815,781

[22] Filed: Jul. 14, 1977

[30] Foreign Application Priority Data

Jul. 19, 1976 [DE] Fed. Rep. of Germany ..... 2632455

[51] Int. Cl.[2] ..... B41F 9/18; B41F 13/44

[52] U.S. Cl. ..... 101/153; 101/216; 101/351; 214/1 D

[58] Field of Search ..... 101/153, 154, 155–157, 101/212, 216, 219, 22, 23, 24, 351; 242/58.6; 105/177; 214/DIG. 4, 1 D, 38 R, 38 C, 38 B; 280/47.34, 47.35, 86, 47.11; 254/2 R

[56] References Cited

U.S. PATENT DOCUMENTS

| | | | |
|---|---|---|---|
| 2,820,644 | 1/1958 | Smith | 214/1 D X |
| 3,232,227 | 2/1966 | Zernov | 101/157 |
| 3,625,145 | 12/1971 | Heatley, Jr. | 101/152 |
| 3,876,087 | 4/1975 | Osta | 101/216 |

FOREIGN PATENT DOCUMENTS

| | | | |
|---|---|---|---|
| 950490 | 2/1964 | United Kingdom | 101/153 |
| 953732 | 4/1964 | United Kingdom | 101/153 |

*Primary Examiner*—J. Reed Fisher
*Attorney, Agent, or Firm*—Fleit & Jacobson

[57] ABSTRACT

To replace the plate cylinder of an intaglio printing press, it is mounted on a carriage which can be retracted from the frame of the press and steered manually, a support for the impression cylinder being raisable and lowerable on the carriage.

8 Claims, 2 Drawing Figures

Figure 1:
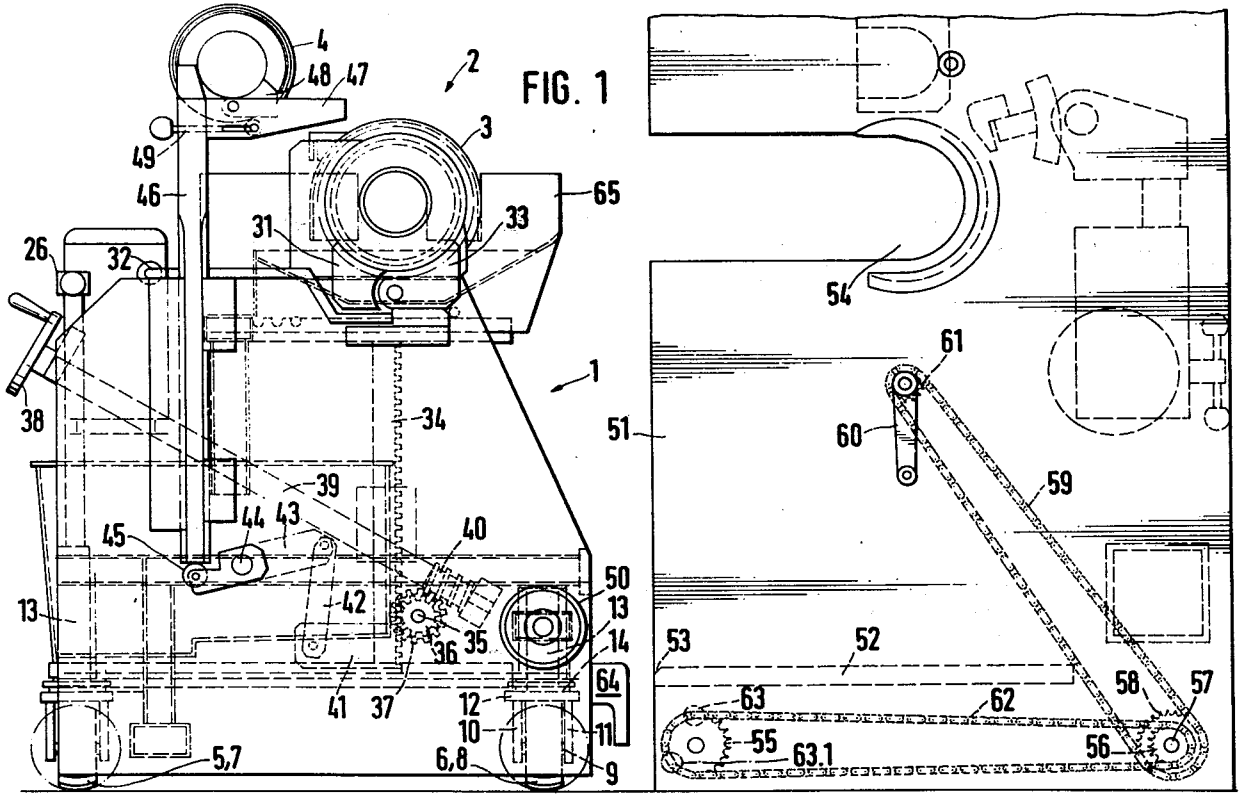

ROTARY INTAGLIO PRINTING PRESS WITH AN INSERTABLE AND WITHDRAWABLE INKING MECHANISM

The invention relates to an apparatus for inserting and withdrawing the inking mechanism transversely to the plate cylinder axis in rotary intaglio printing presses, comprising a carriage with wheels mounted in steering pins and guide rollers.

To re-equip rotary intaglio printing presses, it is known to uncouple the plate cylinder from the drive after printing and to wheel it away from the printing press together with the ink trough located thereunder on a carriage.

In the intaglio printing press of the above-mentioned kind known from U.S. Pat. No. 3,232,227, the plate cylinder can be wheeled out of the frame of the printing press together with the inking mechanism mounted on a carriage and, after turning the wheels in their vertical guides, also withdrawn and taken away from the space between two printing press units by displacing it in the axial direction of the cylinder. However, the required rotation of the wheels about their vertical guides is extremely cumbersome for the operator because the weight of the plate cylinder and the ink trough as well as the friction between the wheels and the floor and it requires repeated attempts to turn the wheels accurately in the desired direction. During displacement, it also often happens that the rotary position of the wheels changes so that the heavy mobile structure can be conveyed to the predetermined position only by frequent to and fro movements.

It is the object of the invention to provide an apparatus which permits the plate cylinder and the inking mechanism to be readily moved to the desired position, which is easy to operate and with which the replacement of the plate cylinder, the impression cylinder and the ink trough can be effected in a short time.

This object is solved according to the invention in that the carriage comprises a manual steering device for the wheels and a raisable and lowerable support for the impression cylinder. In this way the carriage can be easily moved into the space between the printing press units and, after turning the wheels through about 90°, also moved into the appropriate printing press.

Preferably, the suspensions of the front and back wheels of the carriage are steerable by track rods which are interconnected by a push rod and steerable by moving a manual lever, the track pins of the one pair of wheels lying on straight lines leading to a point midway between the front wheels so that they form a so-called steering trapezium together with the steering pins. In this way the carriage can be accurately steered and, whilst stationary, switched to a second direction of movement at right-angles to the first direction so that the carriage may also be driven between narrow spaces and from there into the printing presses. To permit steering of the back wheels without the back wheels turning out of their longitudinal position, the push rod can be mounted in an elongate hole on a pin connected to the suspension of one rear wheel.

In a development of the invention, one back wheel comprises two track pins which successively dip into corresponding slots of the track rod, one of the track pins being arranged on a smaller radius. This corrects the error caused by the steering trapezium when the wheels are transversely positioned.

In a further development of the invention, the carriage is provided with transporting hooks which are engaged by a transporting rod mounted on chains, so that the carriage can be pulled into the operative position.

Preferably, the raisable and lowerable bearings for the impression cylinder and the raising and lowering motion of the ink trough are coupled to each other by levers in the carriage so that they move in opposite directions.

The lengths of the levers may have a ratio of one is to two so that when the cylinders are replaced by cylinders having different diameters, the differences in diameter are compensated.

Figure 2:
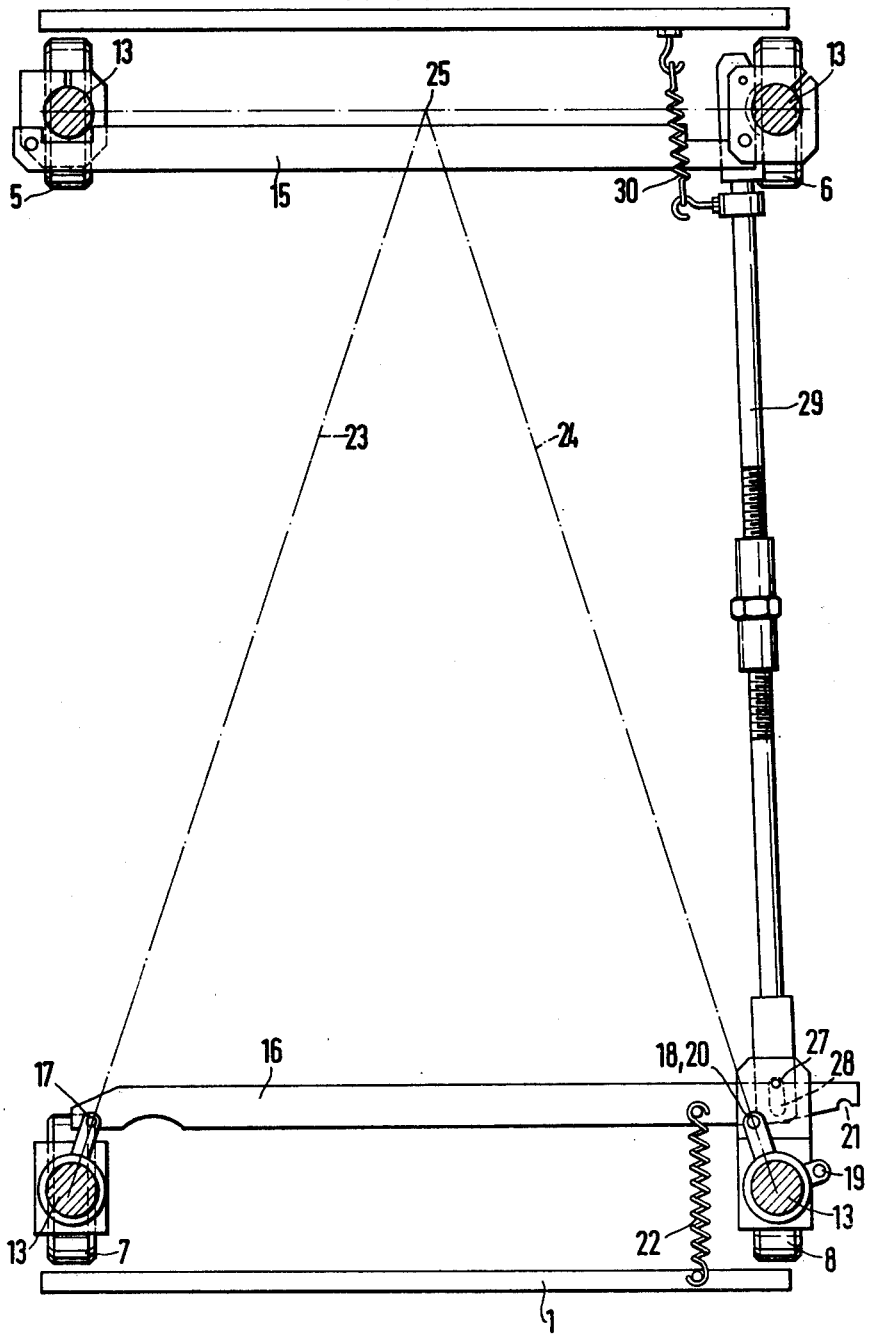

An example of the invention will now be described in more detail with reference to the drawing in which:

FIG. 1 is an end-side elevation of the apparatus and of a printing press unit, and FIG. 2 is a plan view of the steering device of the carriage.

A carriage 1 comprises equipment 2 for receiving a plate cylinder 3 and an impression cylinder 4. It is mounted on four wheels 5 to 8. The wheels 5 to 8 are loosely rotatable on axles 9 which are secured in bars 10, 11. The bars 10, 11 are rigidly secured to plates 12 having a vertically upwardly directed steering pin 13. Between each plate 12 and the frame of the carriage 1, pressure bearings 14 are provided to take up the weight of the carriage. The steering pins 13 are loosely rotatably mounted in the frame of the carriage 1. Their centre lines pass through the centre of the supporting surface of the respective wheels 5 to 8. The plates 12 or the steering pins 13 of the front wheels 5, 6 are pivotably interconnected by a first track rod 15 and the rear wheels 7, 8 by a second track rod 16, the plate 12 or the steering pin 13 of the wheel 7 comprising a track pin 17 which is fixed to one of these parts and which is rotatably mounted in the track rod 16.

Two track pins 18, 19 are fixed to the plate 12 or the steering pin 13 of the wheel 8, the track pin 18 being engageable in a slot 20 and the track pin 19 in a slot 21.

One end of a tension spring 22 is secured to the track rod 16, the other end being connected to the frame of the carriage 1. By means of the spring 22, the track rod 16 or its slots 20, 21 are securely held on the track pin 18 or 19. The track pins 17, 18 are disposed on radius vectors 23, 24 between the steering pins 13 about a midpoint 25 of the axes of the front wheels 5, 6. This creates the so-called steering trapezium 13 (7), 17, 18, 13 (8). By means of this steering geometry, the back wheels 7, 8 move substantially on their theoretical rolling curves necessary for frictionless running, so that frictional forces between the floor and wheel are avoided when turning around corners and steering and movement proceeds without effort.

The steering pin 13 of the back wheel 7 is extended upwardly and, at operating height, comprises an operating lever 26 which has an axis deflected transversely with respect to the axis of the steering pin, the operating lever serving to steer the back wheels 7, 8 at will.

A further pin 27 is fixed to the plate 12 or the steering pin 13 of the back wheel 8 and to this there is pivoted by means of an elongate hole 28 a push rod 29 which is pivoted to the suspension of the front wheel 6. By means of the elongate hole 28, steering deflections of about 45° are possible when moving in a direction parallel to the axis of the plate cylinder 3, without the steering movements being transmitted to the front wheels 5, 6.

On further rotation of the operating lever 26 about the axis of the steering pin 13 beyond this angle, one can switch from longitudinal to transverse travel in that the pull rod 29 transmits the motion exceeding this angle to the front wheels 5, 6. To compensate for the error arising out of the steering trapezium 13 (7) 17, 18, 13 (8) when switching to transverse travel, which error would prevent a 90° position from being reached at the wheel 8, the track pin 19 is provided on a smaller radius than is the track pin 18. It engages in the slot 21 when the track pin 18 is disengaged from the slot 20.

The missing angular path of the wheel 8 is compensated by means of this larger transmission ratio so that, after switching to transverse travel, all four wheels 5 to 8 are perpendicular to the axis of the plate cylinder 3. The push rod 29 is kept under tension by the tension spring 30. By means of the tension spring 30, the wheels 5, 6 are held in their position parallel to the plate cylinder axis.

The device for receiving the plate cylinder 3 and the impression cylinder 4 consists of supports 31, 33 for the plate cylinder 3, which supports are arranged at the ends of the plate cylinder 3 and receive same, the supports 33 being actuatable by hand by means of a pull rod 32.

The ink trough 65 can be raised and lowered by racks 34 guided at both sides of the frame of the carriage 1. The racks are driven by pinions 36 secured to a common shaft 35 which is rotatably mounted in the frame of the carriage 1, a wormwheel 37 also being secured thereto. The wormwheel 37 is in mesh with a worm 40 secured to a shaft 39 that is driven by a hand wheel 38.

Levers 41 are secured to the racks 34 and to the free ends of these levers there are pivoted bars 42 which are in turn pivoted to double levers 43. The double levers 43 are loosely rotatably mounted in the carriage 1 by their pivots pins 44. Their other ends comprise rollers 45 which engage the lower edges of guide rods 46 which are connected to supports 47 for the impression cylinder 4. The supports 47, as are the supports 31, secured against rolling away of the impression cylinder by means of abutments 48 which can be brought to their retaining position by a manually actuatable pull rod 49. By turning the hand wheel 38, the ink trough 65 is lowered and the supports 47 of the impression cylinder 4 are simultaneously raised so that, on replacement of a first plate cylinder 3 by a second cylinder, an impression cylinder 4 of different diameter as well as the ink trough 65 will take up the correct position in relation to the plate cylinder 3. In addition to the ink trough 65, the carriage 1 also contains an ink supply vessel equipped with an ink pump for pumping the ink up into the ink trough.

On each side of the carriage 1 rollers 50 are provided which, when the carriage 1 is inserted in the frame 51, roll on bars 52 secured to the frame 51 of the printing press.

The bars 52 have a bevel 53 at the side facing the rollers 50 so that the latter can readily reach the upper edge serving as the running surface. Beneath the bearing pan 54 for the plate cylinder 3, the running surfaces of the bars 52 slope downwardly so that, on insertion, the supports 31 of the carriage 1 are lowered and the plate cylinder 3 is released therefrom.

Sprockets 55, 56 are loosely rotatably mounted at the inside of the frame 51 to both sides of the printing press, the sprockets 56 being fixed to a shaft 57. A sprocket 58 over which a chain 59 passes is also secured to the shaft 57.

Loosely rotatably mounted in the frame 51 of the printing press beneath the bearing pan 54 there is a hand crank 60 which is secured to a sprocket 61 over which the chain 59 is also passed. Chains 62 to which a transporting bar 63 is secured pass over the sprockets 55, 56. By turning the hand crank 60, the transporting bar 63 can be moved to the position 63.1 in which it lies against a stop (not shown).

Secured to the frame of the carriage 1 there are two transporting hooks 64 which, with the motion of the carriage 1, can be pushed over the bar 63 in its position 63.1. By turning the hand crank 60, the transporting bar 63 engages in the hooks 64 and pulls the carriage 1 or the rollers 50 on the running surfaces of the bars 52 and the carriage 1 is pulled into the printing press until the bearings of the plate cylinder 3 lie in the bearing pans 54. In this position the plate cylinder 3 and impression cylinder 4 are locked in their bearings and connected to their drives.

I claim:

1. An apparatus for inserting and removing from a rotary intaglio printing press an inking mechanism having a plate cylinder, an impression cylinder, and an ink trough, the apparatus being positionable so that the inserting and removing is in a direction transverse to the axis of the plate cylinder, said apparatus comprising:

a movable carriage;

support means carried by said carriage for supporting the inking mechanism;

movement means operatively associated with said support means for raising said support means to insert the inking mechanism and for lowering said support means to remove the inking mechanism;

a pair of front wheels and a pair of back wheels for supporting said carriage;

mounting means for interconnecting said front and said back wheels and said movable carriage including:

steering pin means including steering pins for interconnecting said front and said back wheels and said movable carriage, and guide rollers for guiding movement of said movable carriage with respect to the rotary intaglio printing press, the rotary intaglio printing press having guide means for cooperating with said guide rollers; and manual steering means for positioning said front and said back wheels in predetermined positions prior to movement of said movable carriage.

2. Apparatus according to claim 1 wherein said mounting means further comprises a first track rod interconnecting said steering pin means of said pair of front wheels, track pins connected to each of said back wheels, a second track rod interconnecting said track pins, a push rod interconnecting said first and said second track rods, said push rod being movable by said manual steering means, said track pins connected to said back wheels lying on straight lines leading to a point midway between the front wheels so that they form a so-called steering trapezium together with the steering pin means interconnecting said front wheels and said movable carriage.

3. Apparatus according to claim 2, wherein said push rod includes an elongate hole defined in one end thereof and wherein the suspension means of one of the back wheels includes a pin engageable with the hole.

4. Apparatus according to claim 2 wherein said suspension means of one of said back wheels includes a second track pin, and wherein said second track rod includes two slots selectively engageable with respective ones of the track pins, one of said track pins being arranged on a smaller radius with respect to the steering pin of said one back wheel than the other.

5. Apparatus according to claim 1 where said movable carriage includes transporting hooks and wherein the rotary intaglio printing press includes a transporting rod mounted on chains and engageable with the transporting hooks so that said movable carriage can be pulled into an operative position with respect to the rotary intaglio printing press.

6. Apparatus according to claim 1 wherein said movement means includes first means for raising and lowering the impression cylinder, second means for raising and lowering the ink trough, the lever means interconnecting said first and said second means in such manner that the impression cylinder and ink trough are moved in opposite directions.

7. An apparatus for inserting and removing from a rotary intaglio printing press an inking mechanism having a plate cylinder, an impression cylinder, and an ink trough, the apparatus being positionable so that the inserting and removing is in a direction transverse to the axis of the plate cylinder, said apparatus comprising:

a movable carriage;

support means carried by said carriage for supporting the inking mechanism;

movement means operatively associated with said support means for raising said support means to insert the inking mechanism and for lowering said support means to remove the inking mechanism;

a pair of front wheels and a pair of back wheels for supporting said carriage;

mounting means for interconnecting said front and said back wheels and said movable carriage including:

steering pin means including steering pins for interconnecting said front and said back wheels and said movable carriage, guide rollers for guiding movement of said movable carriage with respect to the rotary intaglio printing press, the rotary intaglio printing press having guide means for cooperating with said guide rollers, a first track rod interconnecting said steering pin means of said pair of front wheels, track pins connected to each of said back wheels, a second track rod interconnecting said track pins, and a push rod interconnecting said first and said second track rods; and manual steering means for positioning said front and said back wheels in predetermined positions prior to movement of said movable carriage, said push rod being movable by said manual steering means, said track pins connected to said back wheels lying on straight lines leading to a point midway between the front wheels so that they form a so-called steering trapezium together with the steering pin means interconnecting said front wheels and said movable carriage, said push rod including an elongate hole defined in one end thereof, the suspension means of one of the back wheels including a pin engageable with the hole, said suspension means of one of said back wheels including a second track pin and said second track rod including two slots selectively engageable with respective ones of the track pins, one of said track pins being arranged on a smaller radius with respect to the steering pin of said one back wheel than the other.

8. Apparatus according to claim 7 wherein said movement means includes first means for raising and lowering the impression cylinder, second means for raising and lowering the ink trough, and lever means interconnecting said first and said second means in such manner that the impression cylinder and ink trough are moved in opposite directions.

* * * * *